US006584658B2

(12) United States Patent
Robinson

(10) Patent No.: US 6,584,658 B2
(45) Date of Patent: Jul. 1, 2003

(54) URN ASSEMBLY

(76) Inventor: Hewitt Robinson, 1641 E. Broad Ripple Ave., Indianapolis, IN (US) 46220

( * ) Notice: Subject to any disclaimer, the term of this patent is extended or adjusted under 35 U.S.C. 154(b) by 0 days.

(21) Appl. No.: 09/740,386

(22) Filed: Dec. 19, 2000

(65) Prior Publication Data

US 2002/0073522 A1 Jun. 20, 2002

(51) Int. Cl.[7] ..... A61G 17/00

(52) U.S. Cl. ..... 27/1

(58) Field of Search ..... 27/1; D99/5; 220/376, 220/DIG. 13, 377; 52/103; 40/124.5

(56) References Cited

U.S. PATENT DOCUMENTS

| | | | | | |
|---|---|---|---|---|---|
| 1,535,179 | A | * | 4/1925 | Poses et al. | 312/114 |
| 2,235,617 | A | * | 3/1941 | Klinzing | 220/288 |
| 3,529,730 | A | | 9/1970 | Thompson | |
| 3,581,452 | A | * | 6/1971 | Jalbert | 27/1 |
| 4,371,091 | A | * | 2/1983 | Gelina | 220/288 |
| 4,887,924 | A | * | 12/1989 | Green | 401/261 |
| D313,325 | S | | 1/1991 | Delaney et al. | |
| 5,064,082 | A | * | 11/1991 | Lombardi et al. | 215/274 |
| 5,287,603 | A | | 2/1994 | Schorman | |
| D374,962 | S | * | 10/1996 | Allen et al. | D99/5 |
| 5,625,933 | A | | 5/1997 | Neuberger et al. | |
| 5,647,108 | A | * | 7/1997 | Crook | 27/1 |
| 5,692,277 | A | | 12/1997 | Chen | |
| 5,715,961 | A | * | 2/1998 | Robertson | 132/318 |
| D395,123 | S | * | 6/1998 | Barretto | D99/5 |
| 6,023,822 | A | | 2/2000 | Luebke | |
| 6,044,532 | A | | 4/2000 | Bowling et al. | |
| D438,361 | S | * | 2/2001 | Robinson | D99/5 |
| D438,362 | S | * | 2/2001 | Robinson | D99/5 |
| D443,400 | S | * | 6/2001 | Robinson | D99/5 |
| D444,288 | S | * | 6/2001 | Robinson | D99/5 |
| 6,279,212 | B1 | * | 8/2001 | Balch | 27/1 |
| D449,418 | S | * | 10/2001 | Robinson | D99/5 |
| 6,295,705 | B1 | * | 10/2001 | Gersten | 27/1 |
| 6,341,437 | B1 | * | 1/2002 | Heiling et al. | 40/124.5 |

FOREIGN PATENT DOCUMENTS

DE 196 08 261 A1 * 8/1996

* cited by examiner

*Primary Examiner*—William L. Miller
(74) *Attorney, Agent, or Firm*—Woodard, Emhardt, Moriarty, McNett & Henry LLP

(57) ABSTRACT

An urn assembly is provided that has a central vertical axis. The urn assembly includes a base, a container supported on the base, and a cap removably positioned about an upper member of the container. The container has a storage compartment, and the upper member of the container has an upper surface sloped at an angle that is non-perpendicular relative to the vertical axis.

30 Claims, 2 Drawing Sheets

URN ASSEMBLY

BACKGROUND OF THE INVENTION

The present invention relates generally to devices for storing crematory remains, and more particularly to an urn assembly.

Cremation of the remains of humans and animals, such as pets, has now become a common alternative for preservation and burial of the deceased. The ashes of the cremated decedent are sometimes distributed in accordance with the wishes of the decedent, but can also be deposited in urns for storage and memorialization purposes. The urns may be retained by the family in a home or other location, or held in permanent storage in a mausoleum.

One example of a storage container for human remains is described in U.S. Pat. No. 5,287,603 to Schorman. The '603 patent describes a storage container for human ashes that includes a bottom portion, a plurality of walls, a rim portion, a cover which fits into a recessed portion of the rim portion, a retainer portion which retains the cover within the recessed portion, and fastener means to fasten the retainer portion to the cover. The cover can include indicia or other decoration. One disadvantage of the container of the '603 patent is that the boxy structure of the container is designed for assemblage with other containers for use in a mausoleum type setting and would not be desirable for a stand alone display. Furthermore, the memorabilia indicia on the cover is oriented in either a vertical or horizontal manner. This orientation makes it difficult to see the cover unless the container is at the eye level of the observer when the cover is vertically oriented, or unless the observer is standing directly over the top of the container if the cover is horizontally oriented.

While the prior art shows various urn assemblies, there remains a need for an urn assembly that provides a memorabilia display that is not met in the prior art. The urn assembly should be pleasing to the eye and dignified while allowing the memorabilia display to be easily viewed. The urn assembly should also be capable of being used in a stand-alone display, as would be desirable in a home or other private setting. The present invention is directed to meeting these needs, among others.

SUMMARY OF THE INVENTION

The present invention is directed to an urn assembly that has a memorabilia display.

According to one aspect of the present invention, there is provided an urn assembly that includes a central vertical axis. The urn assembly includes a base, a container supported on the base, and a cap removably positioned about an upper member of the container. The container has a storage compartment, and the upper member of the container has an upper surface sloped at an angle that is non-perpendicular relative to the vertical axis.

In one form, the cap includes a plate member oriented generally parallel to the upper surface of the upper member, and the cap includes a lower portion that extends downwardly from the plate member. The lower portion and the plate member define a cavity for receiving the upper member. In a further form, the plate member has a window formed therethrough.

According to a further aspect of the invention, there is provided an urn assembly having a central vertical axis. The urn assembly includes a base having a generally horizontal bottom support surface and a container having a storage compartment that is supported on the base. The container includes a body portion having an upper end and a lower end, and an upper member extending upwardly from the upper end of the body portion. The body portion defines a ledge at the upper end around the upper member. A cap is removably positionable about the upper member, and the cap is supported by the ledge forming a gap between the upper surface of the upper member and a plate member of the cap.

In a preferred form, the upper member has an upper surface that is sloped at a non-perpendicular angle relative to the vertical axis. In another form, the cap has a plate member removably attached to a lower portion. The plate member is parallel to the upper surface of the upper member.

These and other aspects, forms, embodiments, advantages, features, and objects of the present invention can be further discerned from the following description of the illustrated embodiments.

DESCRIPTION OF THE ILLUSTRATED EMBODIMENTS

Figure 1:
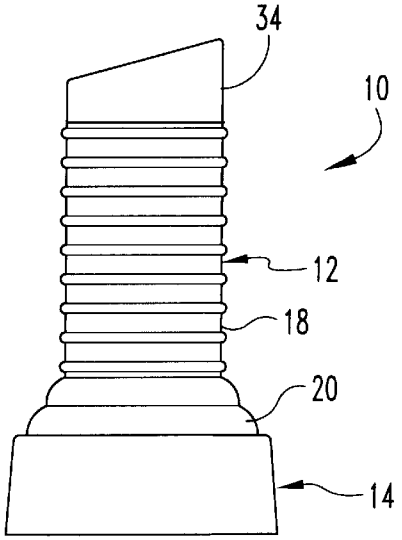
FIG. 1 is a side elevational view of an urn assembly of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated devices, and any such further applications of the principles of the invention as illustrated therein are contemplated as would normally occur to one skilled in the art to which the invention relates.

Referring now to FIG. 1, there is illustrated therein an urn assembly 10 according to one aspect of the present invention. Urn assembly 10 has a central vertical axis C extending therethrough. Urn assembly 10 includes a container 12 supported on a base 14. A cap 34 is removably positionable on container 12. Urn assembly 10 provides for the display of memorabilia, such as a photo, engraved plate or other indicia on the top of container 12. Cap 34 holds the memorabilia in place on top of container 12 and the memorabilia can be viewed through a window provided through cap 34. Container 12 is generally cylindrically shaped with a circular cross-section in the illustrated embodiment; however, other shapes for container 12 are also contemplated, such as square, octagonal, hexagonal, oval or other cross-sectional shape as would occur to those skilled in the art.

Figure 2:
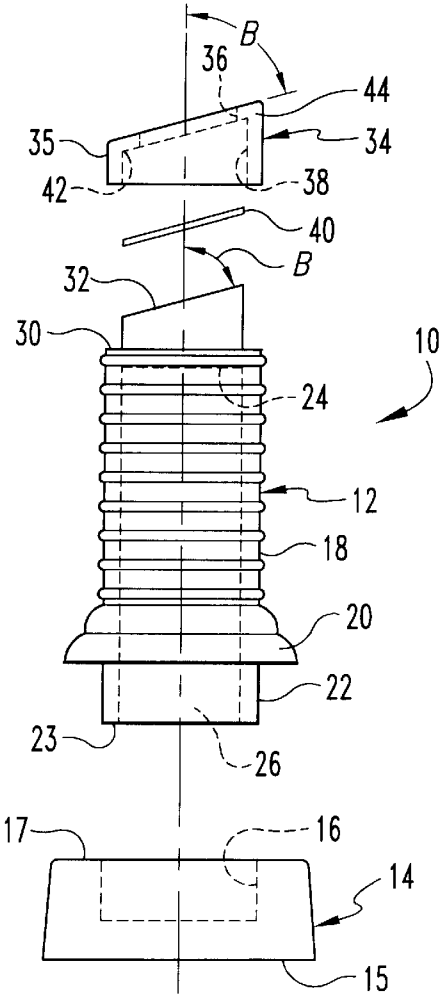
FIG. 2 is an exploded side elevational view of the urn assembly of FIG. 1.
Figure 3:
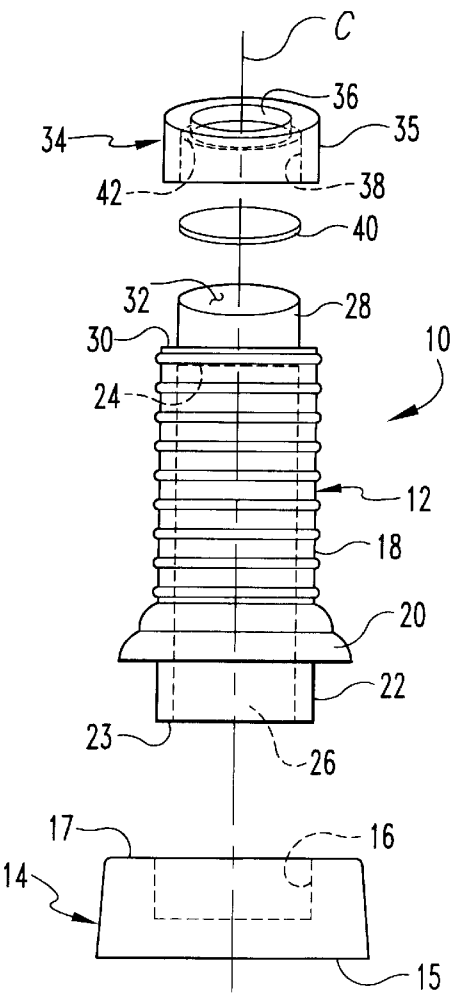
FIG. 3 is an exploded front elevational view of the urn assembly of FIG. 1.

Referring now further to FIGS. 2 and 3, an exploded view of urn assembly 10 is provided. Container 12 includes a body portion 18 having an enlarged portion 20 supported by an upper surface 17 of base 14. A lower member 22 extends downwardly from and is preferably integrally formed with body portion 18, and is positionable in a pocket 16 formed in upper surface 17 of base 14. Base 14 includes a bottom surface 15 that rests on a support surface, such as a floor, ground, table top or display pedestal. Base 14 has a generally square profile when viewed from the top giving base 14 a blocky shape. Other shapes for base 14 are also contemplated, including a circular profile when viewed from the top giving base 14 a cylindrical shape.

Container 12 defines a compartment 26 opening at a bottom surface 23 of lower member 22. Compartment 26 extends upwardly from bottom surface 23 and substantially through body portion 18 to an upper wall 24. A jar or other crematory ash containing device (not shown) that is preferably sealable can be placed in pocket 16, and container 12 placed over the jar so that lower member 22 is positioned in pocket 16, and base 14 supports container 12 thereon. Urn assembly 10 can be used for human or pet crematory ashes, and compartment 26 can be sized appropriately for the desired use. In one specific form, compartment 26 has a 220 cubic inch capacity.

Container 12 includes an upper member 28 extending upwardly from and preferably integrally formed with upper wall 24 of body portion 18. Upper member 28 preferably has a generally circular cylindrical shape that is truncated along an upper surface 32 such that, when viewed from a direction normal thereto, upper surface 32 has an elliptical shape. Other shapes are also contemplated for upper member 28, such as ovoid, elliptical, square, rectangular, or other polygonal cylindrical shapes. Upper member 28 preferably has a reduced width compared to body portion 18. A ledge 30 is formed around upper member 28 at the junction between upper member 28 and upper wall 24. Upper member 28 includes upper surface 32 that is non-perpendicularly oriented with respect to central axis C, and upper surface 32 forms an angle B with central axis C. In one preferred form, angle B is about 65 to 75 degrees. It is further contemplated that angle B could range from more than 0 degrees to less than about 90 degrees.

Memorabilia display 40 is supported on upper surface 32. Memorabilia display 40 can include, for example, a picture or piece of inscribed paper and a glass cover positionable thereover, or a piece of engraved stone or wood. Other types of memorabilia as would occur to those skilled in the art are also contemplated, so long as it is removably positionable or permanently affixed to upper surface 32 and cap 34 can then be placed over upper member 28 to maintain the positioning of memorabilia display 40 thereon.

Urn assembly 10 further includes cap 34 removably positionable about upper member 28. Cap 34 has a lower portion 35 and a plate member 44 integrally formed with lower portion 35. Plate member 44 forms angle B with respect to axis C, and plate member 44 extends parallel with upper surface 32 of upper member 28. Cap 34 defines a lower cavity 38 sized and shaped to receive upper member 28 in form fitting engagement, preferably with a friction fit therebetween. It is further contemplated that fasteners could be provided to secure cap 34 to container 12. Plate member 44 includes a window 36 formed therethrough to allow memorabilia display 40 to be observed when cap 34 is placed on upper member 28. Plate member 44 forms a lip 42 around lower cavity 38 that extends over a portion of upper surface 32 when cap 34 is placed on upper member 28. A gap is formed between lip 42 and upper surface 32 that is sized to receive memorabilia display 40 therebetween.

Memorabilia display 40 is positioned between lip 42 and upper surface 32 when cap 34 is placed on upper member 28. Preferably, the gap between lip 42 and upper surface 32 is sized so that cap 34 and upper member 28 contact memorabilia display 40 to prevent memorabilia display 40 from moving relative to upper surface 32. The inclination of upper surface 32 facilitates viewing of memorabilia display 40, while removable cap 34 allows memorabilia display 40 to be easily accessed without disruption to the ashes stored in compartment 26.

Figure 5:
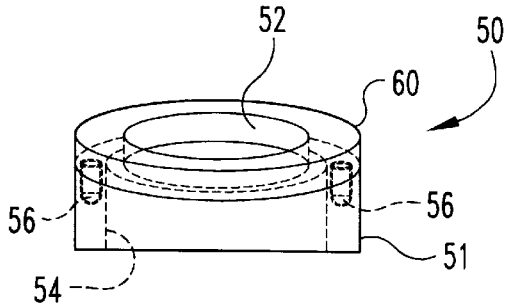
FIG. 5 is a front elevational view of the cap of FIG. 4.
Figure 4:
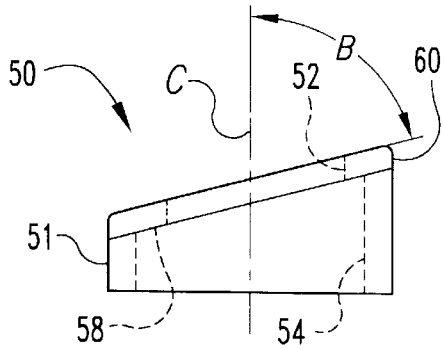
FIG. 4 is a side elevational view of an alternate embodiment cap useable with the urn assembly of FIG. 1.
Figure 6:
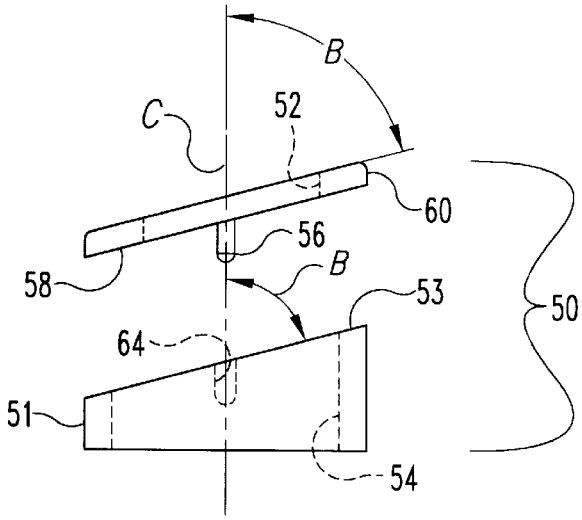
FIG. 6 is an exploded view of the cap of FIG. 4.

Referring now to FIGS. 4–6, an alternative embodiment cap is illustrated therein and designated at 50. Cap 50 is similar in many respects to cap 34 except cap 50 has a removable plate member 60 secured to a lower portion 51. Cap 50 is removably positionable about upper member 28. Lower portion 51 defines a lower cavity 54 sized and shaped to receive upper member 28 preferably in form fitting frictional engagement. Plate member 60 includes a window 52 formed therethrough to allow memorabilia display 40 to be observed when cap 50 is placed on upper member 28. Plate member 60 forms a lip 58 around lower cavity 54 that extends over a portion of upper surface 32 when cap 50 is placed on upper member 28. Memorabilia display 40 is positionable between lip 58 and upper surface 32 when cap 50 is placed on upper member 28, and memorabilia display 40 is preferably in contact with lip 58 and upper surface 32 to maintain the positioning of memorabilia display 40 relative to upper surface 32.

Plate member 60 has a pair of pins 56 extending downwardly therefrom that fit into holes 64 formed in lower portion 51, providing the desired alignment between plate member 60 and lower portion 51 when plate member 60 is positioned thereon. Pins 56 also prevent plate member 60 from moving relative to lower portion 51 unless plate member 60 is lifted vertically from lower portion 51. Lower portion 51 has an upper surface 53 oriented at angle B with central axis C which supports plate member 60 so that plate member 60 is also oriented at angle B with respect to axis C. In another embodiment, lower portion 51 could be integrally formed with upper member 28, and plate member 60 could be removably attached to the integral lower portion 51.

Plate member 60 can be removed as desired to provide access to memorabilia display 40 without removing lower portion 51 from upper member 28. In this embodiment, lower portion 51 could be secured to upper member 28 with fasteners or the like to prevent relative movement between upper member 28 and lower portion 51, while memorabilia display 40 could be easily accessed by removing plate member 60. The inclination of upper surface 32 and plate member 60 facilitates viewing of memorabilia display 40, while allowing memorabilia display 40 to be easily accessed without disruption to the ashes stored in compartment 26.

The present invention contemplates that urn assembly 10 can be made from wood or marble using fabrication techniques known in the art. Other materials known to those skilled in the art may also be used for urn assembly 10.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An urn assembly having a central vertical axis, the urn assembly comprising:

a base having a bottom support surface;

a container having a storage compartment, said container being supported on said base, said container including an upper member, said upper member having an upper surface sloped at an angle that is non-perpendicular relative to the vertical axis, wherein the central vertical axis extends through said sloped upper surface; and a cap removably positionable about said upper member.

2. The urn assembly of claim 1, wherein said container includes:

a body portion having an upper end and a lower end;

said upper member extending upwardly from said upper end of said body portion; and a lower member extending downwardly from said lower end of said body portion.

3. The urn assembly of claim 2, wherein said base includes a pocket for receiving said lower member.

4. The urn assembly of claim 1, wherein said cap includes an upper plate member oriented generally parallel to said upper surface and a lower portion extending downwardly from said plate member and along an outer surface of said upper member, said plate member and said lower portion defining a cavity for receiving said upper member.

5. The urn assembly of claim 4, wherein said plate member has a window formed therethrough sized for viewing said upper surface when said cap member is positioned on said upper member.

6. The urn assembly of claim 1, wherein said angle is in the range from about 65 degrees to about 75 degrees relative to the vertical axis.

7. The urn assembly of claim 1, wherein said container includes a body portion having an upper end and a lower end, said upper member extending upwardly from said upper end of said body portion, said body portion defining a ledge around said upper member at said upper end.

8. The urn assembly of claim 7, wherein said cap includes an upper plate member and a lower body portion, said cap being supported on said ledge with a gap formed between said plate member and said upper surface.

9. The urn assembly of claim 1, wherein said cap extends around an outer surface of a side wall of said upper member.

10. An urn assembly having a central vertical axis, said urn assembly comprising:

a base;

a container having a storage compartment sized for receipt of ashes of a decedent therein, said container being supported on said base, said container including:

a body portion having an upper end and a lower end;

an upper member extending upwardly from said upper end of said body portion, said upper member having an upper surface, wherein said upper surface is sloped at a non-perpendicular angle relative to the vertical axis;

said body portion defining a ledge at said upper end around said upper member; and a cap removably positionable about said upper member, said cap being supported by said ledge wherein a gap is formed between said upper surface and said cap, said gap being sized for receipt of a memorabilia display therein.

11. The urn assembly of claim 10, wherein said angle is in the range from about 65 degrees to about 75 degrees relative to the vertical axis.

12. The urn assembly of claim 10, wherein said cap includes an upper plate member oriented generally parallel to said upper surface and a lower portion extending downwardly from said plate member, said plate member and said lower portion defining a cavity sized and shaped to receive said upper member.

13. The urn assembly of claim 12, wherein said plate member has a window formed therethrough.

14. The urn assembly of claim 12, wherein said plate member is removably attached to said lower portion.

15. An urn assembly having a central vertical axis, the urn assembly comprising:

a base having a bottom support surface;

a container having a storage compartment, said container being supported on said base, said container including an upper member, said upper member having an upper surface sloped at an angle that is non-perpendicular relative to the vertical axis; wherein the central vertical axis extends through said sloped upper surface; and a cap about said upper member, said cap including an upper plate member removably attached to a lower portion.

16. The urn assembly of claim 15, wherein said upper member is cylindrical.

17. The urn assembly of claim 15, wherein said plate member has a window formed therethrough sized for viewing said upper surface when said cap member is positioned on said upper member.

18. The urn assembly of claim 15, wherein said lower portion is removably positionable about said upper member.

19. The urn assembly of claim 15, wherein said plate member has at least one pin extending therefrom, and said lower portion includes at least one hole formed therein for receiving said at least one pin when said plate member is positioned on said lower portion.

20. An urn assembly having a central vertical axis, said urn assembly comprising:

a base;

a container having a storage compartment, said container being supported on said base, said container including:

a body portion having an upper end and a lower end;

an upper member extending upwardly from said upper end of said body portion, said upper member having an upper surface, wherein said upper surface is sloped at a non-perpendicular angle relative to the vertical axis;

said body portion defining a ledge at said upper end around said upper member; and a cap removably positionable about said upper member, said cap being supported by said ledge wherein a gap is formed between said upper surface and said cap.

21. The urn assembly of claim 20, wherein said angle is in the range from about 65 degrees to about 75 degrees relative to the vertical axis.

22. The urn assembly of claim 20, wherein said cap includes an upper plate member oriented generally parallel to said upper surface and a lower portion extending downwardly from said plate member, said plate member and said lower portion defining a cavity sized and shaped to receive said upper member.

23. The urn assembly of claim 22, wherein said plate member has a window formed therethrough.

24. The urn assembly of claim 22, wherein said plate member is removably attached to said lower portion.

25. An urn assembly having a central vertical axis, said urn assembly comprising:

a base;

a container having a storage compartment, said container being supported on said base, said container including:

a body portion having an upper end and a lower end;

an upper member extending upwardly from said upper end of said body portion, said upper member having an upper surface;

said body portion defining a ledge at said upper end around said upper member; and a cap removably positionable about said upper member, said cap being supported by said ledge wherein a gap is formed between said upper surface and said cap, said cap member having a window therethrough for viewing a memorabilia display on said upper surface.

26. The urn assembly of claim 25, wherein said upper surface is sloped at a non-perpendicular angle relative to the vertical axis.

27. The urn assembly of claim 26, wherein said angle is in the range from about 65 degrees to about 75 degrees relative to the vertical axis.

28. The urn assembly of claim 25, wherein said cap includes an upper plate member oriented generally parallel to said upper surface and a lower portion extending downwardly from said plate member, said plate member and said lower portion defining a cavity sized and shaped to receive said upper member.

29. The urn assembly of claim 28, wherein said plate member is removably attached to said lower portion.

30. An urn assembly having a central vertical axis, the urn assembly comprising:

a base having a bottom support surface;

a container having a storage compartment, said container being supported on said base, said container including an upper member, said upper member having an upper surface sloped at an angle that is non-perpendicular relative to the vertical axis;

a cap positionable upon said upper member such that a gap is formed between said upper surface and said cap; and a memorabilia display in said gap.

* * * * *